US006814536B2

(12) United States Patent
Sakaguchi et al.

(10) Patent No.: US 6,814,536 B2
(45) Date of Patent: Nov. 9, 2004

(54) VACUUM PUMP

(75) Inventors: Yoshiyuki Sakaguchi, Narashino (JP); Yasushi Maejima, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 23 days.

(21) Appl. No.: 10/294,827

(22) Filed: Nov. 14, 2002

(65) Prior Publication Data

US 2003/0095861 A1 May 22, 2003

(30) Foreign Application Priority Data

Nov. 19, 2001 (JP) ..... 2001-353746

(51) Int. Cl.[7] ..... F04D 19/04
(52) U.S. Cl. ..... 415/9; 415/90; 415/174.4
(58) Field of Search ..... 415/9, 90, 143, 415/170.1, 174.2, 174.4, 200; 417/423.4

(56) References Cited

FOREIGN PATENT DOCUMENTS

EP 0887556 12/1998

EP 1030062 8/2000

OTHER PUBLICATIONS

Patent Abstracts of Japan vol. 2000, No. 11, Jan. 3, 2001 Publication No. 2000 220596 A (Osaka Vacuum Ltd), Publication Date Aug. 8, 2000.

Patent Abstracts of Japan vol. 2000, No. 10, Nov. 17, 2000 Publication No. 2000 205183 A (Mitsubishi Heavy Ind Ltd), Publication Date Jul. 25, 2000.

*Primary Examiner*—Edward K. Look
*Assistant Examiner*—Dwayne White
(74) *Attorney, Agent, or Firm*—Adams & Wilks

(57) ABSTRACT

The present invention provides a vacuum pump which reduces a damaging torque produced when a rotor rotating at high-speed crashes into a screw stator or the like. The vacuum pump has a rigid ring disposed around the screw stator such that a shock load from the screw stator causes the rigid ring to rotate. When a brittle facture occurs in the rotor rotating at high-speed, for example, and a part of the rotor crashes into the screw stator, a rotating torque, i.e., a damaging torque causing the entire vacuum pump to rotate is likely to occur. However, this damaging torque is absorbed by the rotation of the rigid ring and eventually subsides.

14 Claims, 5 Drawing Sheets

PRIOR ART

VACUUM PUMP

BACKGROUND OF THE INVENTION

1. Field of the Invention

The present invention relates to vacuum pumps used in semiconductor manufacturing apparatus and so on, and more particularly, the present invention relates to a vacuum pump which reduces a damaging torque produced when a rotor rotating at high-speed crashes into a screw stator or the like.

2. Description of the Related Art

In a process such as dry etching, chemical vapor deposition (CVD), or the like performed in a high-vacuum process chamber in semiconductor manufacturing step, a vacuum pump such as a turbo-molecular pump is used for producing a high vacuum in the process chamber by exhausting gas from the process chamber.

FIG. 5 is a vertical sectional view of a conventional vacuum pump. In the vacuum pump, a pump case 1 is provided with a gas suction port 1-2 at the top portion thereof. The pump case is in communication with a process chamber 17 by connecting the flange 1*a* to the process chamber 17 with fastening bolts 15.

The vacuum pump fixed to the process chamber 17 is provided with a rotor shaft 12, a rotor 2 and rotor blades 4, and the rotor shaft 12 rotates together with the rotor 2 and the rotor blades 4 when the vacuum pump is in operation. Also, the vacuum pump is also provided with stator blades 5, and a screw stator 7 fixed therein. Gas molecules in the process chamber 17 is exhausted out from the gas exhaust port 1-3 passing through the gas suction port 1-2 and then the pump case 1 by the interaction between the rotor blades 4 rotating at high-speed and the stator blades 5 and the other interaction between the rotor 2 at high-speed rotating and the screw stator 7 having thread grooves 8 thereon.

A light alloy is generally used and, in particular, an aluminum alloy is widely used as the structural material of the rotor 2, the rotor blades 4, the pump case 1, the stator blades 5, and so forth which form the vacuum pump, since the aluminum alloy is excellent in machining and can be precisely processed without difficulty. However, the hardness of aluminum alloy is relatively low as compared with other materials used for the structural material, and accordingly aluminum alloy may cause a creep fracture depending on the operating condition. Also, a brittle fracture may occur mainly caused by a stress concentration at the lower portion of the rotor 2, when the vacuum pump is in operation.

In the conventional vacuum pump having the above-described structure, when a brittle fracture occurs in the rotor 2 rotating at high-speed, for example, and a part of the rotor 2 crashes into the screw stator 7, since the screw stator 7 has an insufficient strength against a shock load caused by this crash, the screw stator 7 cannot absorb such a shock load and therefore radially crashes into a base member 1-1. Accordingly, this shock load produces a high rotating torque (hereinafter, referred to as "damaging torque") which causes the entire vacuum pump to rotate and which causes problems in that the entire pump case 1 is distorted, the fastening bolts 15 fastening the vacuum pump to the process chamber 17 are broken by this distortion torque, and the process chamber 17 is broken by the large damaging torque transferred thereto.

SUMMARY OF THE INVENTION

The present invention is made to solve the above-described problems. Accordingly, it is an object of the present invention to provide a vacuum pump which reduces a damaging torque produced when a rotor rotating at high-speed crashes into a screw stator or the like so as to prevent a damaging torque transferred to the process chamber or the like.

A vacuum pump according to the present invention comprises a rotor rotatably provided in a pump case; a plurality of rotor blades integrally provided with an outer circumferential surface of the upper part of the rotor; a plurality of stator blades positioned and arranged between the rotor blades; a screw stator arranged opposite to the outer circumferential surface of the lower portion of the rotor; and a rigid ring positioned and arranged at the outside the screw stator so as to be rotated by the shock load from the screw stator.

In the vacuum pump according to the present invention, when a brittle fracture occurs in the rotor rotating at high-speed, for example, and a part of the rotor crashes into the screw stator, a damaging torque causing the entire vacuum pump to rotate is likely to be generated. However, this damaging torque is absorbed by the rotation of the rigid ring and eventually subsides.

The vacuum pump according to the present invention may further comprise a buffer member between the screw stator and the rigid ring.

The vacuum pump according to the present invention may further comprise a low-frictional portion provided on at least one of the outer circumferential surface of the rigid ring and a surface opposite to the outer circumferential surface of the rigid ring so as to reduce the surface frictional force of the corresponding surface.

The vacuum pump according to the present invention may further comprise a buffer member between the screw stator and the rigid ring, and a low-frictional portion provided on at least one of the outer circumferential surface of the rigid ring and a surface opposite to said outer circumferential surface of the rigid ring so as to reduce the surface frictional force of the corresponding surface.

The vacuum pump according to the present invention may further comprise a base member, which serves as a base of the pump case and which is disposed on the outer circumferential surface of the rigid ring. Also, in this vacuum pump, a gap is provided between the base member and the rigid ring The vacuum pump according to the present invention may further comprise a base member, which serves as a base of the pump case and which is disposed on the outer circumferential surface of the rigid ring, and a low-frictional portion is provided on a surface of the base member opposite to the outer circumferential surface of the rigid ring so as to reduce the surface frictional force of the surface opposite to the outer circumferential surface of the rigid ring.

The vacuum pump according to the present invention may further comprise a base member, which serves as a base of the pump case and which is disposed on the outer circumferential surface of the rigid ring, a gap is provided between the base member and the rigid ring and a low-frictional portion is provided on a surface of the base member opposite to the outer circumferential surface of the rigid ring so as to reduce the surface frictional force of the surface opposite to the outer circumferential surface of the rigid ring.

In the vacuum pump according to the present invention, the rigid ring is preferably composed of a metal selected from the group consisting of a titanium alloy, a nickel-chromium copper, a chromium-molybdenum steel, and a stainless steel.

In the vacuum pump according to the present invention, the buffer member may be provided with a plurality of hollows disposed along the rotating direction of the rotor.

In the vacuum pump according to the present invention, the buffer member may be provided with a plurality of hollows and hollow boundary portions alternately disposed along the rotating direction of the rotor, wherein each hollow boundary portion serves as the boundary between the adjacent hollows and is constructed so as to lean to a direction into which the hollow boundary portion is easily broken down by the shock load from the screw stator.

In the vacuum pump according to the present invention, the hollows provided in the buffer member are preferably crushed by the shock load when the shock load caused by the crash of the rotor into the screw stator is transferred to the buffer member.

In the vacuum pump according to the present invention, each hollow may have a parallelogram or diamond sectional shape.

In the vacuum pump according to the present invention, the low-frictional portion may adopt a structure in which a low-frictional surface treatment is applied to the surface whose frictional force is to be reduced or a low-frictional material is bonded to the surface.

In the vacuum pump according to the present invention, the low-frictional surface treatment is preferably performed by fluoroplastic coating, fluoroplastic-contained nickel plating, or fluoroplastic-impregnated ceramic coating.

DESCRIPTION OF THE PREFERRED EMBODIMENTS

Vacuum pumps according to preferred embodiments of the present invention will be described in detail with reference to FIGS. 1 to 4.

Figure 1:
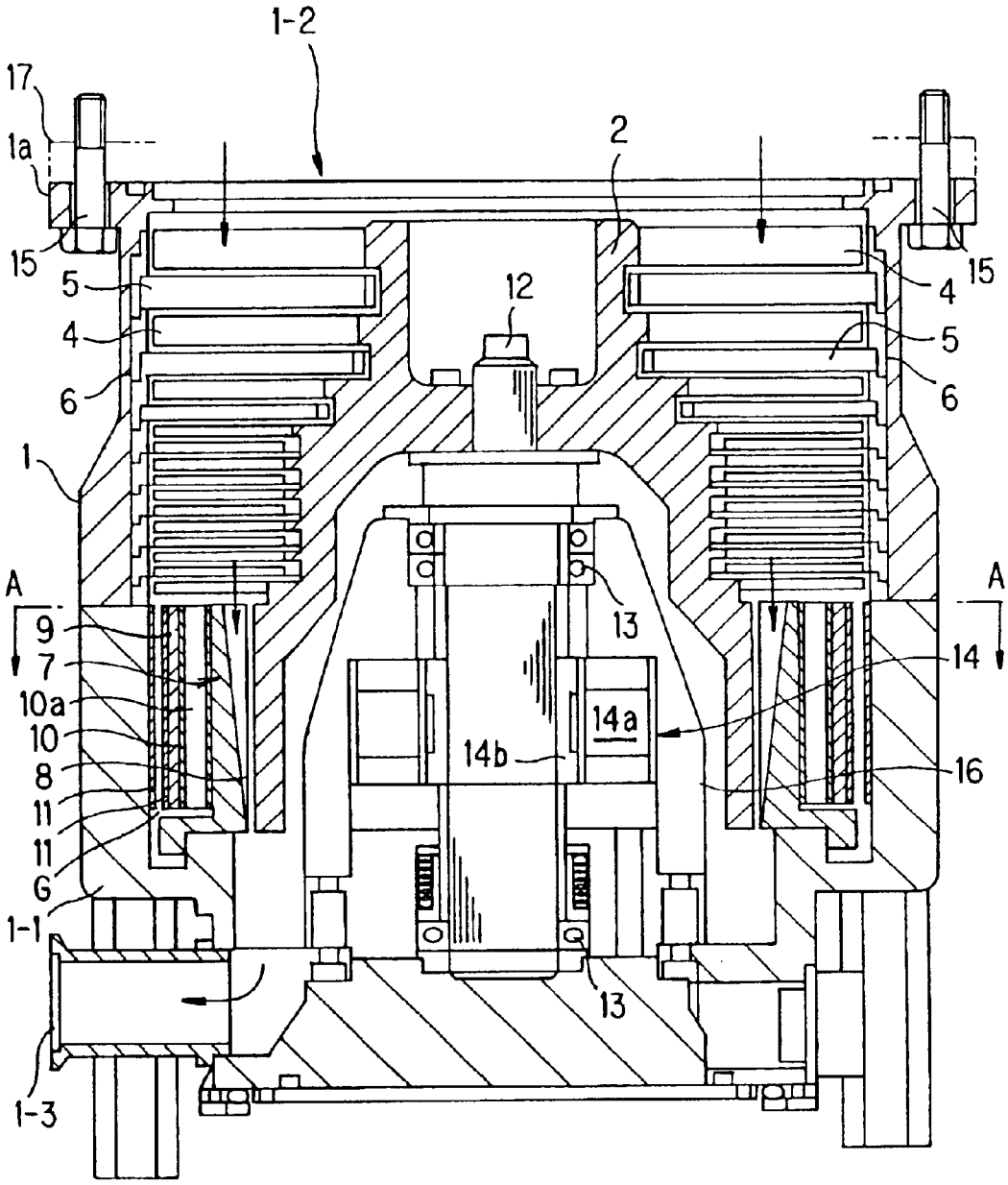
FIG. 1 is a vertical sectional view of a vacuum pump according to a first embodiment of the present invention.
Figure 2:
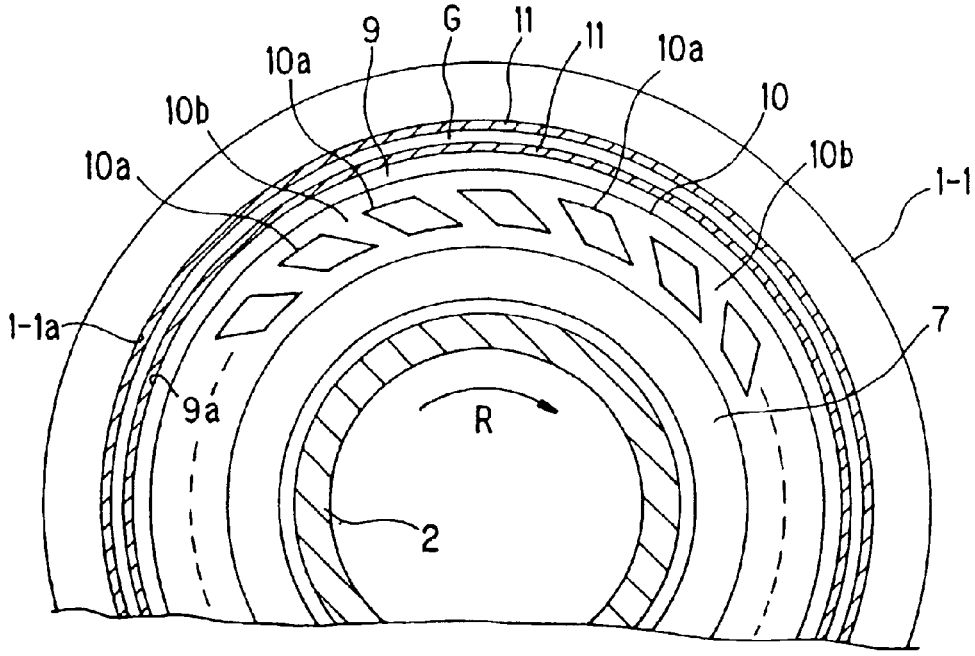
FIG. 2 is a transverse sectional view taken along the line A—A indicated in FIG. 1.

FIG. 1 is a vertical sectional view of a vacuum pump according to a first embodiment of the present invention, and FIG. 2 is a transverse sectional view taken along the line A—A indicated in FIG. 1. Referring to FIGS. 1 and 2, a vacuum pump according to the first embodiment will be described. The vacuum pump has a cylindrical pump case 1 and a cylindrical rotor 2 rotatably disposed in the pump case 1 such that the top portion of the rotor 2 is directed to a gas suction port 1-2 provided at the top portion of the pump case 1.

Pluralities of processed rotor blades 4 and stator blades 5 are arranged between the outer circumferential surface of the upper part of the rotor 2 and the inner wall of the upper part of the pump case 1 such that these blades 4 and 6 are alternately provided in a direction along the rotation axis of the rotor 2.

The rotor blades 4 are integrally provided on the outer circumferential surface of the upper part of the rotor 2 so as to rotate together with the rotor 2. On the other hand, the stator blades 5 are positioned and arranged between the adjacent upper and lower rotor blades 4 via spacers 6 fixed to the pump case 1 and also are secured to the inner wall of the pump case 1.

A stationary screw stator 7 is arranged opposite to the outer circumferential surface of the lower portion of the rotor 2. The entire screw stator 7 has a cylindrical shape so as to surround the lower portion of the rotor 2 and is integrally secured to a base member 1-1 serving as a base of the pump case 1. In addition, thread grooves 8 are formed on the surface of the screw stator 7 opposite to the rotor 2.

A rigid ring 9 is positioned and arranged at the outside of the screw stator 7 and has a ring or cylindrical shape so that the entire rigid ring 9 surrounds the entire screw stator 7.

Also, the rigid ring 9 has a sufficient stiffness against a calculated shock load by assuming that the rotor 2 rotating at high-speed crashes into the screw stator 7. Such a shock-proof rigid ring 9 is composed of a metal such as a titanium alloy, a nickel-chromium copper, a chromium-molybdenum steel, or a stainless steel.

An outer circumferential surface 9*a* of the rigid ring 9 is disposed on the base member 1-1 serving as the base of the pump case 1. A gap G having a predetermined thickness is provided between the base member 1-1 and the rigid ring 9.

In this embodiment, the screw stator 7 and the rigid ring 9 have a metal buffer member 10 inserted therebetween. The entire buffer member 10 has a ring or cylindrical shape so as to surround the screw stator 7.

The buffer member 10 is provided with a plurality of hollows 10*a* therein, each having a parallelogram or diamond sectional shape when viewed from the top portion of the pump case 1, as shown in FIG. 2. The hollows 10*a* and a plurality of hollow boundary portions 10*b* are alternately and regularly disposed in the rotating direction of the rotor 2. Each hollow boundary portion 10*b* serves as the boundary between the adjacent hollows 10*a* and is constructed so as to lean to a direction into which the hollow boundary portion 10*b* is easily broken down by a shock load from the screw stator 7. That is, each hollow 10*a* having the parallelogram or diamond sectional shape has a leading edge at the inner side thereof in the rotating direction R of the rotor 2, as indicated in FIG. 2.

A low-frictional portion 11 for reducing the surface friction of the outer circumferential surface 9*a* is provided on the outer surface 9*a* of the rigid ring 9. The low-frictional portion 11 is provided on the outer surface 9*a* by applying a low-frictional surface treatment to the outer surface 9*a*, by bonding a low-frictional material to the outer surface 9*a*, or by making the rigid ring 9 from a low-frictional material. The low-frictional surface treatment is performed by, for example, fluoroplastic (Teflon, a product trademark of E. I. DuPont de Nemours and Company) coating, fluoroplastic-contained nickel plating, or fluoroplastic-impregnated ceramic coating.

As described above, the outer surface 9*a* of the rigid ring 9 is directed to the base member 1-1 serving as the base of the pump case 1. Also, in this embodiment, another low-frictional portion 11 is provided on a surface 1-1*a* of the base member 1-1 opposite to the outer circumferential surface of the rigid ring. The other low-frictional portion 11 may adopt the same material and formed in the same manner as that on the outer surface 9*a*.

In this embodiment, the rotor 2 has a rotor shaft 12 integrally mounted thereto and coaxially disposed therein.

Although various types of bearing means are possible for rotatably supporting the rotor shaft 12, this embodiment adopts a structure in which the rotor shaft 12 is rotatably supported by ball bearings 13.

The rotor shaft 12 is driven to rotate by a drive motor 14 having a motor stator 14*a* and a motor rotor element 14*b*. In this type of the drive motor, the motor stator 14*a* is fixed to a stator column 16 disposed inside the rotor 2 and the motor rotor 14*b* is fixed to the outer circumferential surface of the rotor shaft 12.

The pump case 1 is provided with the gas suction port 1-2 at the top portion thereof and a gas exhaust port 1-3 at the lower portion thereof. The gas suction port 1-2 is in communication with a vacuum container, which is to be highly evacuated, such as a process chamber 17 used in semiconductor manufacturing apparatus. The gas exhaust port 1-3 is in communication with the lower pressure side.

Referring again to FIGS. 1 and 2, the operation of the vacuum pump having the above-described structure according to the first embodiment will be described. The arrows in the figures indicate the flowing direction of an exhaust gas in the vacuum pump.

The vacuum pump shown in the figures can be used for evacuating, for example, the process chamber 17 used in semiconductor manufacturing apparatus. In this example, the gas suction port 1-2 at the top portion of the vacuum pump is in communication with the process chamber 17 (not shown) by connecting a flange 1*a* at the top portion of the pump case 1 to the process chamber 17 with fastening bolts 15.

In the vacuum pump connected to the process chamber 17 as described above, an auxiliary pump (not shown) connected to the gas exhaust port 1-3 is activated. When the process chamber 17 is evacuated to the vacuum level of $10^{-1}$ Torr, the vacuum pump is switched on. Then, the drive motor 14 is activated so as to rotate the rotor shaft 12 together with the rotor 2 and the rotor blades 4 at high speed.

When the rotor blade 4 rotates at high speed at the uppermost stage, the rotor blade 4 imparts a downward momentum to the gas molecules entering through the gas suction port 1-2, and the gas molecules with this downward momentum are guided by the stator blade 5 to be transferred to the next lower rotor blade 4 side. By repeating this imparting of momentum to the gas molecules and transferring operation, the gas molecules are transferred from the gas suction port 1-2 to the thread grooves 8 provided on the lower portion side of the rotor 2 in order. The above-described operation of exhausting gas molecules is called a gas molecule exhausting operation performed by the interaction between the rotating rotor blades 4 and the stationary stator blades 5.

The gas molecules reaching the thread grooves 8 by the above-described gas molecule exhausting operation are compressed from an intermediate flow state to a viscous flow state, are transferred toward the gas exhaust port 1-3 by the interaction between the rotating rotor 2 and the thread grooves 8, and are eventually exhausted to the outside via the gas exhaust port 1-3 by the auxiliary pump (not shown).

When a brittle fracture occurs in the rotor 2 rotating at high speed as described above and thus causes a part of the rotor 2 to crash into the screw stator 7, a damaging torque causing the entire vacuum pump to rotate is likely to occur. However, in this embodiment, such a damaging torque is absorbed by the plastic deformation of the buffer member 10 and the rotation of the rigid ring 9 and eventually subsides.

More particularly, in the vacuum pump according to the first embodiment, when a part of the rotor 2 rotating at high speed crashes into the screw stator 7 and thereby causes the shock load caused by this crash to be transferred to the buffer member 10 from the screw stator 7, the shock load from the screw stator 7 causes the hollows 10*a* in the buffer member 10 to be crushed. Thus, the shock load caused by the above-described crash is absorbed and reduced by such a plastic deformation of the crushable buffer member 10.

When the hollows 10*a* in the buffer member 10 are completely crushed, the damaging torque still remaining in this state causes the rigid ring 9 to rotate. Since the rigid ring 9 rotates while contacting the base member 1-1 of the pump case 1 in a sliding manner, the energy generated by the remaining damaging torque is converted to the frictional heat generated between the rigid ring 9 and the base member 1-1. When the energy produced by the damaging torque is consumed, the rotation of the rigid ring 9 stops.

Accordingly, since the energy caused by the remaining damaging torque is completely consumed by the above-described rotation of the rigid ring 9, the vacuum pump according to the first embodiment prevents occurrence of problems in that the process chamber 17 and the like connected to the vacuum pump are broken by the above-described damaging torque transferred thereto, the pump case 1 is distorted, or some of the fastening bolts 15 fastening the vacuum pump to the process chamber 17 are broken by this distortion torque.

Also, in the vacuum pump according to this embodiment, since the low-frictional portions 11 are provided on the outer surface 9*a* of the rigid ring 9 and also on the surface 1-1*a* opposite to the outer surface 9*a*, the frictional force between the rigid ring 9 and the base member 1-1 caused by the rotation of the rigid ring 9 is small. Accordingly, the frictional force does not cause the pump case 1 to be distorted or the fastening bolts 15 to be broken.

Furthermore, in the vacuum pump according to the first embodiment, since the hollow boundary portions 10*b* in the buffer member 10 are constructed so as to lean to a direction into which the hollow boundary portions 10*b* are easily broken down by the shock load from the screw stator 7, the shock load from the screw stator 7 causes the hollow boundary portions 10*b* to be easily bent and thus causes the hollows 10*a* in the buffer member 10 to be easily crushed. As a result, the buffer member 10 effectively absorbs such a shock load.

Figure 3:
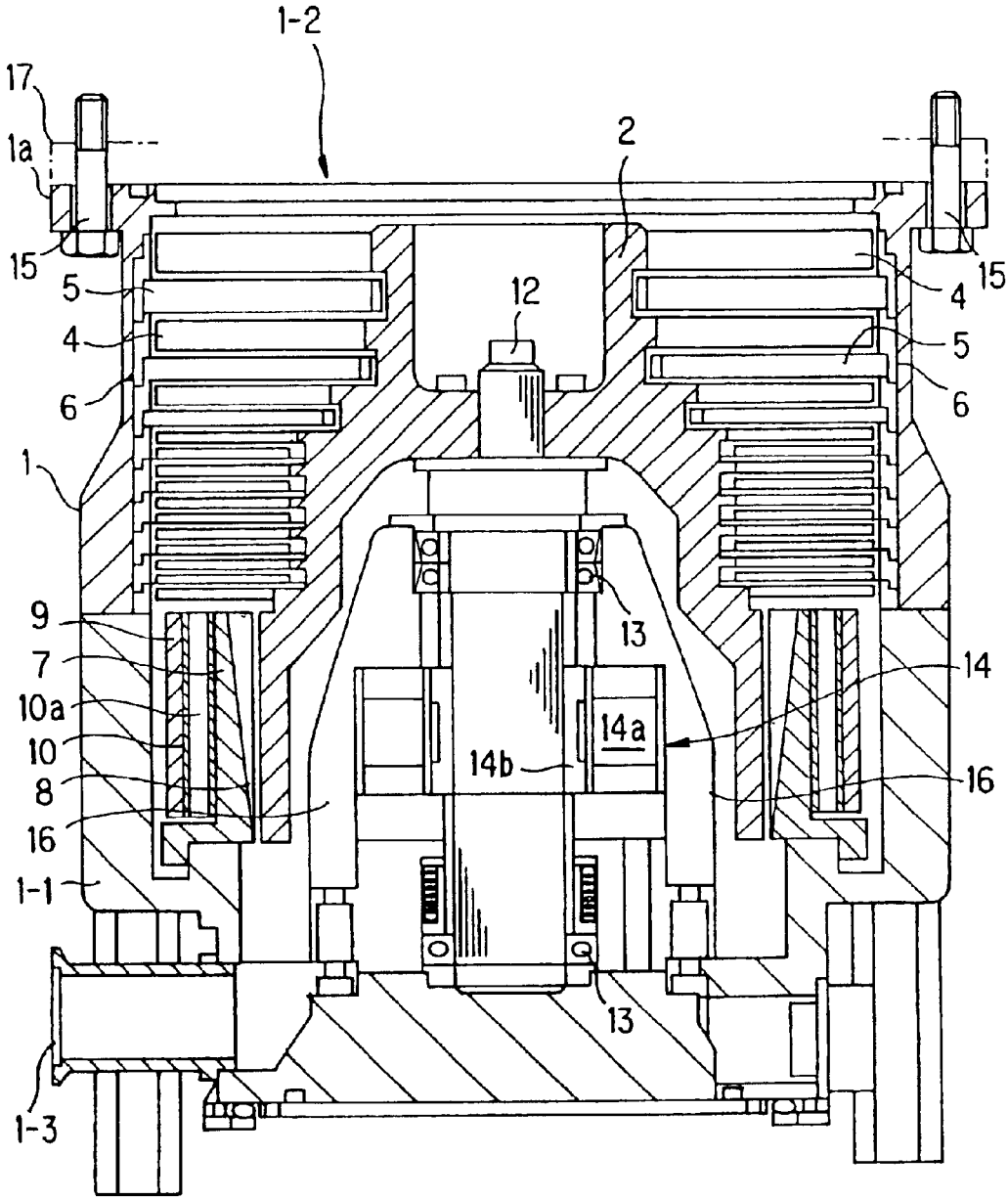
FIG. 3 is a vertical sectional view of another vacuum pump according to a second embodiment of the present invention.
Figure 4:
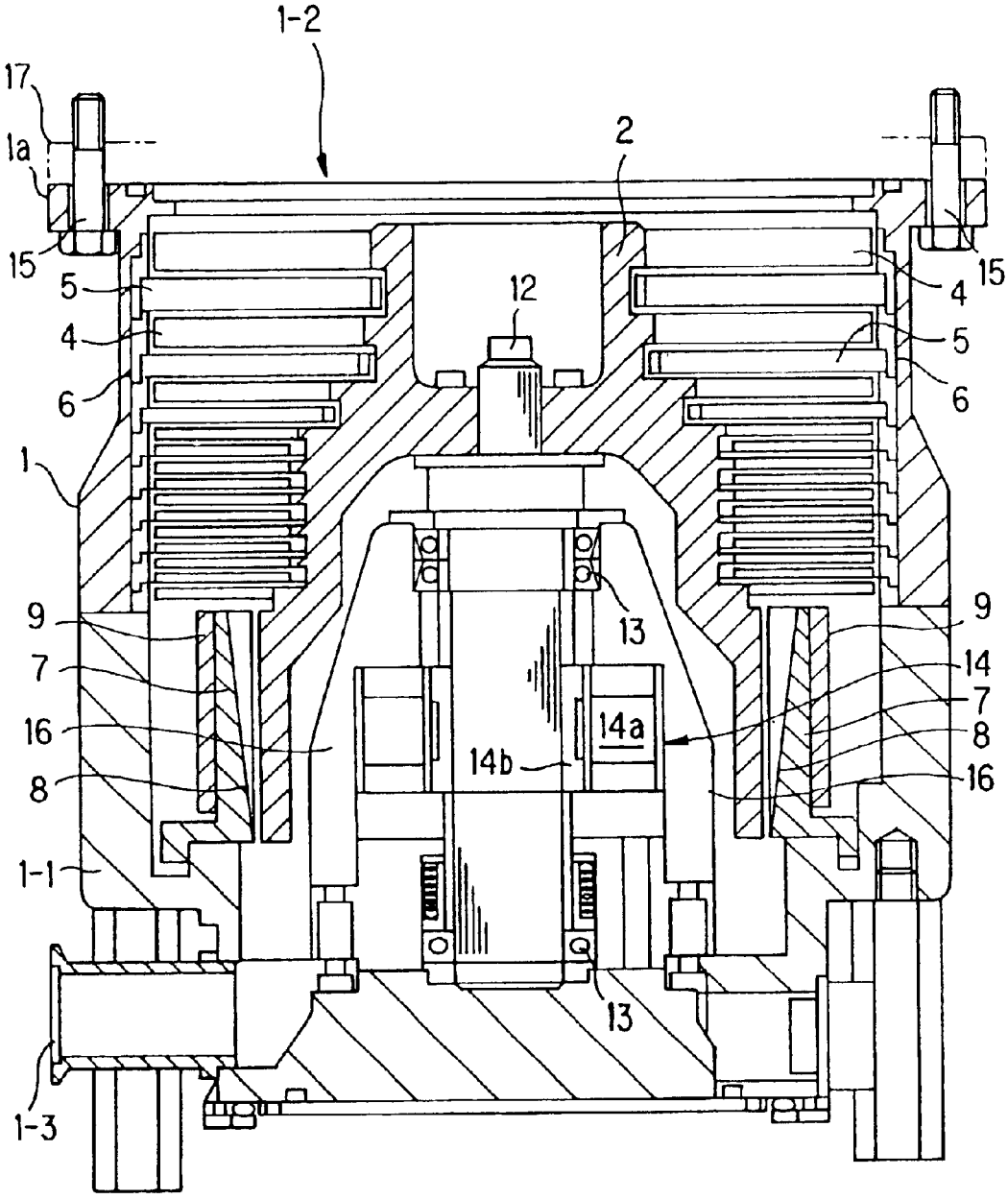
FIG. 4 is a vertical sectional view of another vacuum pump according to a third embodiment of the present invention.
Figure 5:
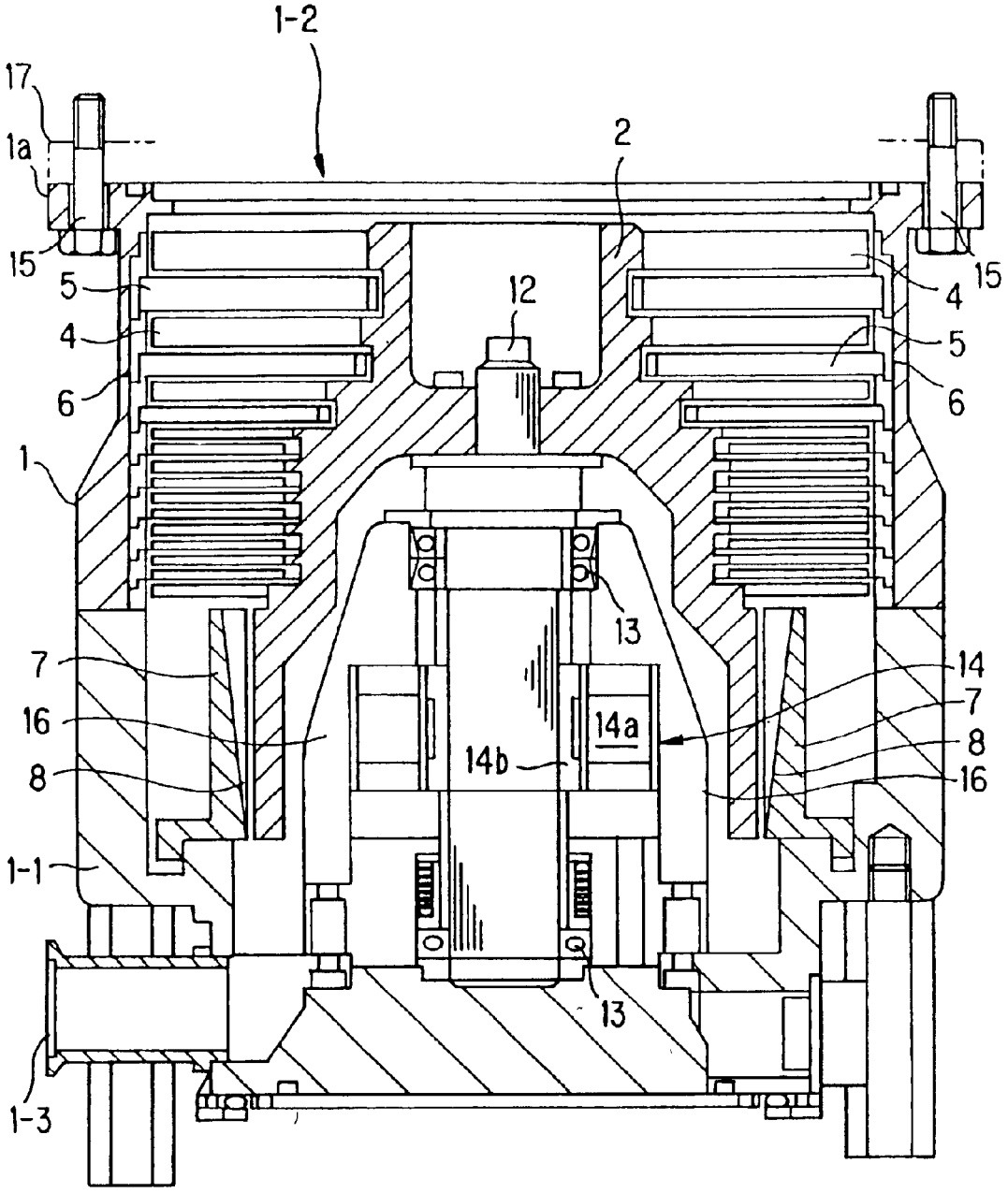
FIG. 5 is a vertical sectional view of a conventional vacuum pump.

Although the vacuum pump according to the first embodiment is provided with a combination of three components consisting of the rigid ring 9, the buffer member 10, and the low-frictional portions 11 by way of example, the other vacuum pumps according to the second and third embodiments may be provided with a combination of only two components consisting of the rigid ring 9 and the buffer member 10 as shown in FIG. 3 and provided with only the rigid ring 9 as shown in FIG. 4, respectively. With these structures of the vacuum pumps according to the second and third embodiments, the rotation of the rigid ring 9 also absorbs the energy of the damaging torque and eventually subsides, thereby preventing the process chamber 17 from being broken by the damaging torque, the pump case 1 from being distorted, and also the fastening bolts 15 from being broken by this distortion torque.

Although, in the above-described embodiments, the low-frictional portions 11 are provided on both the outer surface 9*a* of the rigid ring 9 and the surface 1-1*a* opposite to the outer surface 9*a*, one low-frictional portion 11 may be provided on either one of the foregoing surfaces 9*a* and 1-1*a*.

Also, in the above-described embodiments, the hollows 10*a*, each having a parallelogram or diamond sectional shape when viewed from the top portion of the pump case 1, are regularly disposed in the buffer member 10 so that the hollow boundary portions 10*b* in the buffer member 10 lean to a direction into which the hollow boundary portions 10*b* is easily broken down by the shock load from the screw stator 7. However, the vacuum pump according to the present invention is not limited to the buffer member 10, in which each hollow 10*a* has a parallelogram or diamond sectional shape, and may have the buffer member 10 in which the hollow 10*a* has one of other shapes including an elliptic sectional shape. As long as the buffer member 10 has the hollows 10*a* therein which cause the hollow boundary portions 10*b* serving as the boundaries between the adjacent hollows 10*a* to lean to the above-described direction, the hollows 10*a* may adopt any sectional shape.

The thread grooves 8 may be formed on the rotor 2 in place of being formed on the screw stator 7. In this case, the thread grooves 8 are formed on the outer circumferential surface of the lower portion of the rotor 2 opposite to the screw stator 7.

Instead of the above-described ball bearings 13, non-contact bearings such as magnetic bearings may be used as means for rotatably supporting the rotor shaft 12.

The vacuum pump according to the present invention has a structure in which the rigid ring rotated by the shock load from the screw stator is positioned and arranged at the outside of the screw stator, as described above. With this structure, when a brittle fracture occurs in the rotor rotating at high-speed, for example, and a part of the rotor crashes into the screw stator, a damaging torque causing the entire vacuum pump to rotate is likely to occur. However, such a damaging torque is absorbed by the rotation of the rigid ring and eventually subsides, thereby preventing occurrence of problems in that the process chamber and the like connected to the vacuum pump are broken by the damaging torque, the pump case is distorted, and also the fastening bolts fastening the vacuum pump to the process chamber are broken by this distortion torque.

What is claimed is:

1. A vacuum pump comprising:

a rotor rotatably provided in a pump case;

a plurality of rotor blades integrally provided on an outer circumferential surface of the upper portion of the rotor;

a plurality of stator blades positioned and arranged between the rotor blades;

a screw stator arranged opposite to the outer circumferential surface of the lower portion of the rotor;

a rigid ring positioned and arranged at the outside of the screw stator so as to be rotated by a shock load from the screw stator; and a base member which serves as a base of the pump case, the base member being disposed on the outer circumferential surface of the rigid ring so that a gap is provided between the base member and the rigid ring.

2. The vacuum pump according to claim 1, further comprising a buffer member between the screw stator and the rigid ring, and a low-frictional portion provided on at least one of the outer circumferential surface of the rigid ring and a surface opposite to said outer circumferential surface of the rigid ring so as to reduce the surface frictional force of the corresponding surface.

3. The vacuum pump according to claim 1, wherein the rigid ring comprises a metal selected from the group consisting of a titanium alloy, a nickel-chromium copper, a chromium-molybdenum steel, and a stainless steel.

4. The vacuum pump according to claim 1, further comprising a buffer member between the screw stator and the rigid ring.

5. The vacuum pump according to claim 4, wherein the buffer member is provided with a plurality of hollows disposed along the rotating direction of the rotor.

6. The vacuum pump according to claim 5, where in the hollows provided in the buffer member are crushed by the shock load when the shock load caused by the crash of the rotor into the screw stator is transferred to the buffer member.

7. The vacuum pump according to claim 5, wherein each hollow has a parallelogram or diamond sectional shape.

8. The vacuum pump according to claim 4, wherein the buffer member is provided with pluralities of hollows and hollow boundary portions alternately disposed between the hollows along the rotating direction of the rotor, wherein each hollow boundary portion serves as the boundary between the adjacent hollows and is constructed so as to lean to a direction into which the hollow boundary portion is easily broken down by the shock load from the screw stator.

9. The vacuum pump according to claim 1, further comprising a low-frictional portion provided on at least one of the outer circumferential surface of the rigid ring and a surface opposite to said outer circumferential surface of the rigid ring so as to reduce the surface frictional force of the corresponding surface.

10. The vacuum pump according to claim 9, wherein the low-frictional portion is a structure formed by applying a low-frictional surface treatment to the surface or by bonding a low-frictional material to the surface.

11. The vacuum pump according to claim 10, wherein the low-frictional surface treatment is performed by fluoroplastic coating, fluoroplastic-contained nickel plating, or fluoroplastic-impregnated ceramic coating.

12. The vacuum pump according to claim 1, further comprising a low-frictional portion provided on a surface of the base member opposite to the outer circumferential surface of the rigid ring so as to reduce the surface frictional force of the surface opposite to the outer circumferential surface of the rigid ring.

13. The vacuum pump according to claim 12, wherein the low-frictional portion is a structure formed by applying a low-frictional surface treatment to the surface or by bonding a low-frictional material to the surface.

14. The vacuum pump according to claim 13, wherein the low-frictional surface treatment is performed by fluoroplastic coating, fluoroplastic-contained nickel plating, or fluoroplastic-impregnated ceramic coating.

* * * * *